United States Patent [19]

Meyerhoff

[11] 4,407,465

[45] Oct. 4, 1983

[54] METHOD FOR GUIDING MISSILES

[75] Inventor: Klaus Meyerhoff, Hamburg, Fed. Rep. of Germany

[73] Assignee: Licentia Patent-Verwaltungs-GmbH, Frankfurt am Main, Fed. Rep. of Germany

[21] Appl. No.: 208,780

[22] Filed: Nov. 20, 1980

[30] Foreign Application Priority Data

Nov. 24, 1979 [DE] Fed. Rep. of Germany ..... 2947492

[51] Int. Cl.[3] ..... F41G 7/22

[52] U.S. Cl. ..... 244/3.16

[58] Field of Search ..... 244/3.13, 3.16, 3.15

[56] References Cited

U.S. PATENT DOCUMENTS

| | | | |
|---|---|---|---|
| 3,366,346 | 1/1968 | McKnight et al. | 244/3.11 |
| 3,725,576 | 4/1973 | Crawford et al. | 244/3.16 |
| 3,743,216 | 7/1973 | Salonimer | 244/3.16 |
| 3,794,272 | 2/1974 | Hecker | 244/3.17 |
| 3,912,198 | 10/1975 | Dell et al. | 244/3.16 |
| 4,143,835 | 3/1979 | Jennings, Jr. et al. | 244/3.16 |
| 4,155,096 | 5/1979 | Thomas et al. | 244/3.16 |
| 4,333,008 | 6/1982 | Misek | 244/3.16 |

OTHER PUBLICATIONS

Stangl, A.; "Luftfahrttechnik, Raumfahrttechnik" (Aerospace Art), 1969, No. 8/9, pp. 208–210.

Pinkus, Walter; *The Washington Post;* "Budget Is Full of Anti-Tank Weapons"; Dec. 1, 1982.

*Primary Examiner*—Charles T. Jordan

*Attorney, Agent, or Firm*—Spencer, Kaye & Frank

[57] ABSTRACT

In a method for guiding a missile by illuminating the target by means of a laser and tracking the target with a sensor system carried by the missile, the step of illuminating is carried out to illuminate the target by means of the laser for a short period of time, and the step of tracking is carried out with the aid of an electronic optical sensor by causing the sensor to sense the laser light reflected from the target and then locking the sensor onto the target region from which such reflection took place.

7 Claims, 2 Drawing Figures

METHOD FOR GUIDING MISSILES

BACKGROUND OF THE INVENTION

The present invention relates to a method for guiding a missile toward a target by illuminating the target by means of a laser beam and tracking the target with a sensor system carried by the missile.

So-called wire or laser beam guided systems are known, as summarized in a paper by A. Stangl published in the periodical "Luftfahrttechnik, Raumfahrttechnik" [Aerospace Art], 1969, No. 8/9, pages 208–210. In wire guided systems, the target is detected by means of a target tracking apparatus which also includes a device for determining the missile position coordinates with respect to the target. The missile emits signals by means of a set of lights attached to its rear and those signals are utilized for taking a bearing on the missile.

The combined target tracking apparatus continuously makes comparisons between the desired and actual missile position values, or coordinates, and transmits the appropriate correction signals to the missile via a wire connection.

With this system it is possible to attain very high firing accuracy. However, in principle it has the serious drawback that the gunner must carefully track the target with his target tracking device during the entire flight of the missile. When greater distances are involved this careful tracking of the target takes several seconds. Such a semiautomatic system is used, for example, for the "Milan" and "Hot" missiles.

Laser guided systems operate in such a manner that a gunner directs a tightly collimated laser beam onto the target to be attacked and thus marks the target. With the aid of a laser light sensor system in its search head, the missile orients itself toward the reflected laser light. This system also has a high hit accuracy but again has the serious drawback that the target must be beamed at during the entire time of flight of the missile.

SUMMARY OF THE INVENTION

It is therefore an object of the present invention to provide a guidance method with which the missile can be homed in on a target after being briefly directed to do so and thereafter follows the target until there is a collision.

The above and other objects are achieved, according to the invention, in a method for guiding a missile by illuminating the target by means of a laser and tracking the target with a sensor system carried by the missile, by performing the step of illuminating in such a manner as to illuminate the target by means of the laser for a short period of time, and performing the tracking step by causing an electronic optical sensor to sense the laser light reflected from the target and then locking the sensor onto the target region from which such reflection took place.

An advantage of this method is that a laser target illuminator need only illuminate the target briefly and therafter an electronic camera with a tracking device takes over the tracking of the target.

DESCRIPTION OF THE PREFERRED EMBODIMENTS

According to the present invention, either the entire target or only a part thereof is marked, or illuminated, by a laser beam only for a short period of time to enable the missile to receive information, via an electronic camera in its search head, identifying those picture details which are to be considered the target. For this purpose, a television camera is connected in series with a tracking device which locks onto the illuminated field of view at the target area. As soon as the target marking laser has been switched off, the television camera with its series connected electronic system determines the gray values of the target area. The target image points retained in this manner are then utilized, by means of a tracking device, to control the flight of the missile on its path to the target.

It must be considered, in this connection, that as the missile nears the target, the television camera receives an image of the target which steadily increases in size.

In order to be able to evaluate the thus continuously changing target pictures, a further feature of the invention provides for measurement or estimation of the distance to the target at the beginning of the flight of the missile and for switching over the focal length of the television camera lens as a function of the calculated time of flight. It is also possible to continuously vary the focal length by equipping the camera with a zoom lens.

With this guidance method according to the invention, the gunner is essentially relieved from having to regulate the path of the missile toward the target.

Figure 1:
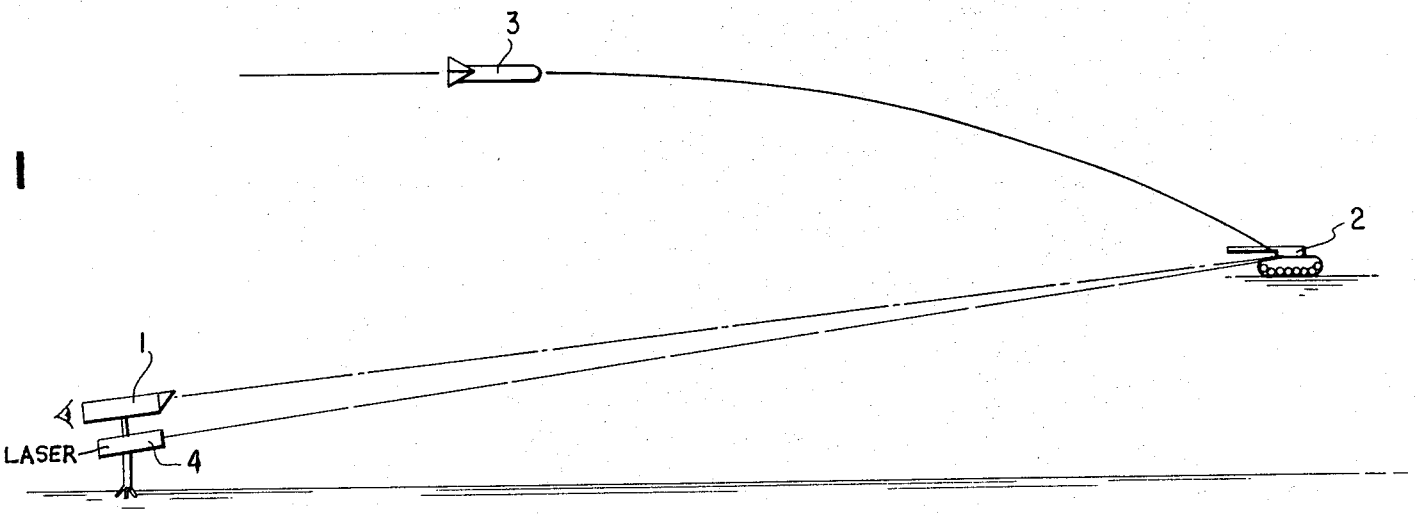
FIG. 1 is a diagrammatic view illustrating the flight of a missile from a launching station to a target
Figure 2:
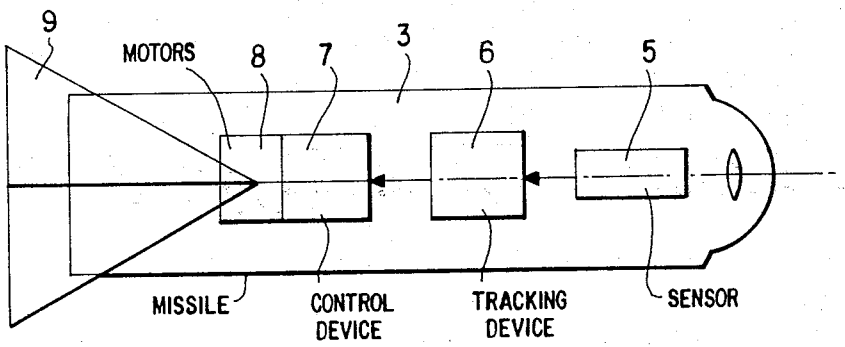
FIG. 2 is a block diagram which schematically shows the components in the missile according to the invention.

Referring now to FIGS. 1 and 2 an aiming device 1 in a launching station for missiles is shown. The gunner has perceived a target 2 and has fired a missile 3 in the direction of the target. A laser 4 preferably a NdYag or a $CO_2$-laser, is installed for briefly marking the target. A sensor 5, i.e. a TV-camera, in the nose of the missile 3 is thereby directed to the target. After the laser has switched off the sensor 5 is further directed to the target. The sensor 5 is electrically followed by a tracking device 6, the tracking window of which is fixed on the briefly illuminated field at the target. The tracking device 6 possesses an electronic memory to memorize the initial scene of the target and to compare the actual video signals with this initial picture. This comparison of the desired and the actual signals in the tracking device 6 generates signals which are introduced into a control device 7. The output signals of this device operate the motors 8 of the rudders 9 of the missile 3 to correct the flight of the missile.

With the approach of the missile 3 to the target 2 the sensor 5 receives an image of the target which steadily increases in size.

For the purpose of accomodation to the distance which decreases with the approach, the sensor can be equipped with a Vario objective or a zoom lens. For this purpose the distance to the target at the beginning of the flight of the missile is estimated and the focal length of the lens of the sensor is switched over as a function of the calculated time of flight.

U.S. Pat. No. 3,366,346 describes a guidance system for missiles in which a target is continuously marked by a laser beam. A searchhead in the front of the missile is thereby locked to the target so illuminated. The missile continues the flight till the target is hit. This is a so-called laser beam guided system in which the missile is connected via a wire to a fixed fire control station. All flight control signals are given to the missile from the ground station via the wire connection.

Another guidance system for missiles is described in the U.S. Pat. No. 3,794,272. The missile described herein utilizes a TV-camera to which a correlator is connected in series. This is followed by a memory which compares the image of the initial scene with the actual images generated by the TV-camera. A zoom lens allows for changes of the scene when the missile approaches the target.

It will be understood that the above description of the present invention is susceptible to various modifications, changes and adaptations, and the same are intended to be comprehended within the meaning and range of equivalents of the appended claims.

I claim:

1. In a method for guiding a missile by illuminating the target by means of a laser and tracking the target with a sensor system carried by the missile, the improvement wherein said step of illuminating is carried out to illuminate the target by means of the laser for a short period of time and to terminate the illumination of the target after the short period of time and before the missile reaches the target, and said step of tracking is carried out with the aid of an electronic optical sensor by causing the sensor to sense the laser light reflected from the target and then locking the sensor onto the target region from which such reflection took place.

2. A method as defined in claim 1 wherein said electronic optical sensor is arranged to form an image of a field of view containing the target, and the missile is provided with a tracking device connected to the sensor for sensing gray levels in the image formed by the sensor and influencing missile guidance on the basis thereof.

3. A method as defined in claim 2 further comprising switching the focal length of the lens of the sensor in conformance to approach of the missile to the target.

4. A method as defined in claim 3 wherein said step of switching is effected in dependence on the distance from the target and on the time of flight of the missile.

5. Guidance method as defined in claim 2 wherein the size of the target which changes upon approach is considered by way of a lens of the type of a zoom lens.

6. A method as defined in claim 2 wherein the sensor is provided with a zoom lens for forming the image, with the focal length of the zoom lens being varied to compensate for the change in target size in the image during approach of the missile to the target.

7. A method as defined in claim 1 wherein said step of locking the sensor onto the target region is performed at least partly after termination of the illumination.

* * * * *